US005562436A

United States Patent [19]

Kawahara et al.

[11] Patent Number: 5,562,436

[45] Date of Patent: Oct. 8, 1996

[54] SCROLL COMPRESSOR HAVING IMPROVED ORBITAL DRIVE MECHANISM

[75] Inventors: Sadao Kawahara, Otsu; Teruyuki Akazawa, Kusatsu; Kunio Iwanami, Moriyama; Masafumi Fukushima; Akihiko Shimizu, both of Kusatsu, all of Japan

[73] Assignee: Matsushita Electric Industrial Co., Ltd., Osaka-fu, Japan

[21] Appl. No.: 449,370

[22] Filed: May 24, 1995

[30] Foreign Application Priority Data

Nov. 30, 1994 [JP] Japan ..... 6-296749

[51] Int. Cl.[6] ..... F04C 18/04; F04C 29/02

[52] U.S. Cl. ..... 418/55.5; 418/55.6; 418/57

[58] Field of Search ..... 418/55.5, 55.6, 418/57

[56] References Cited

U.S. PATENT DOCUMENTS 5,308,231 5/1994 Bookbinder et al. ..... 418/55.5

FOREIGN PATENT DOCUMENTS 3-105001 5/1991 Japan ..... 418/55.5

5-248371 9/1993 Japan ..... 418/55.5

*Primary Examiner*—John J. Vrablik

*Attorney, Agent, or Firm*—Wenderoth, Lind & Ponack

[57] ABSTRACT

A scroll compressor includes an orbital drive mechanism for causing orbiting of an orbiting scroll relative to a stationary scroll. The orbiting scroll is formed with a generally cylindrical boss extending in a direction away from the stationary scroll. The orbital drive mechanism includes a main shaft rotatably supported by a compressor housing, an eccentric shaft extending from one end face of the main shaft and having a longitudinal axis parallel to, but offset laterally from a longitudinal axis of the main shaft, and an eccentric bush having a socket inserted rotatably into the cylindrical boss. The eccentric shaft, engaged in the socket, is of a non-circular cross-section having short and long axes perpendicular to each other. The eccentric shaft has rounded opposite apexes lying on the long axis thereof to define first and second rounded side faces, while the socket has a first inner wall portion of a smaller curvature confronting the first rounded side face of the eccentric shaft and a second inner wall portion of a greater curvature confronting the second rounded side face of the eccentric shaft. The eccentric shaft is spaced a predetermined distance from inner wall portions of the socket in the direction in which the short axis of the eccentric shaft extends so that the eccentric bush can swing relative to the eccentric shaft about a center of curvature of the first rounded side face of the eccentric shaft, thus varying the orbiting radius.

6 Claims, 6 Drawing Sheets

SCROLL COMPRESSOR HAVING IMPROVED ORBITAL DRIVE MECHANISM

BACKGROUND OF THE INVENTION

1. Field of the Invention

The present invention relates generally to a scroll compressor for use in, for example, an air conditioner, a refrigerator or the like and, more particularly, to an orbital drive mechanism used in the scroll compressor.

2. Description of Related Art

In view of numerous features including a compact and light-weight construction, a high operating efficiency, a low noise generation and so on, scroll compressors have gained wide market acceptance. The scroll compressor and its operating principle are disclosed in numerous patents and technical literature and are, therefore, well known by those skilled in the art. As an example of the scroll compressor, Japanese Patent Publication (examined) No. 57-49721, published in 1982, discloses a scroll-type fluid machine which makes use of a link-coupled radial follower mechanism for orbiting one of the scroll members relative to the other while defining a plurality of closed working pockets between scroll wraps thereof.

The scroll compressor disclosed in U.S. Pat. No. 4,824,346 includes an eccentric bush mechanism which may be regarded as a developed version of the link-coupled radial follower mechanism.

A conventional scroll compressor of a type utilizing the eccentric bush mechanism is shown in FIG. 6 in a longitudinal sectional representation and reference thereto will now be made for discussion of the prior art.

The conventional scroll compressor shown in FIG. 6 comprises a compressor housing 101 having a rear end portion to which a stationary scroll member 102 in the form of a stationary end plate 103 having a stationary wrap 104 formed on one surface thereof is secured. An orbiting scroll member 106 in the form of an orbiting end plate 107 having an orbiting wrap 108 formed on one surface thereof is accommodated within the compressor housing 101 with the orbiting wrap 108 being in engagement with the stationary wrap 104 of the stationary scroll member 102 to define a plurality of sealed working pockets 105 therebetween. The opposite surface of the orbiting end plate 107 remote from the orbiting wrap 108 is formed with a generally cylindrical boss 109 in which an annular orbiting bearing 110 is disposed. An eccentric bush 111 in the form of a stud shaft or a disc having a substantial wall thickness and having an eccentric hole 112 defined therein is rotatably housed within the cylindrical boss 109 integral with the orbiting end plate 107 through the annular orbiting bearing 110.

A main shaft 114 has one end formed with a driving pin 115 so as to protrude axially from an end face thereof. The driving pin 115 integral with the main shaft 114 is rotatably received in the eccentric hole 112 of the eccentric bush 111 so that, during rotation of the main shaft 114 about its own longitudinal axis, the driving pin 115 undergoes an eccentric motion relative to the main shaft 114 to impart an orbiting motion to the orbiting scroll member 108. The main shaft 114 is adapted to be driven by an external drive source (for example, an automobile engine though not shown) providing a rotary drive force which is transmitted thereto through a drive transmitting element (not shown) such as, for example, an endless belt, by way of an electromagnetic clutch 118. The electromagnetic clutch 118 is mounted on that portion of the main shaft 114 which protrudes outwardly from the compressor housing 1 through an axial seal assembly 117.

In this design, upon rotation of the main shaft 114 and under the influence of a force such as a force developed by the pressure of a gaseous medium being compressed, the eccentric bush 111 swings about the axis of the driving pin 115 along a generally arcuate path. Consequently, the orbiting wrap 108 undergoes an orbiting motion relative to the stationary wrap 104 while maintaining lines of contact therebetween to achieve a radial seal with which the closed working pockets 105 are sealed.

On the orbiting end plate 107, an annular race 119 and a retainer 120, both made of a high hard steel, are arranged and, similarly, an annular race 122 and a retainer 123 are arranged on steps 121 formed in an inner front wall of the compressor housing 101. These races and retainers support a circular row of balls 124 in position without allowing the balls 124 to displace radially and axially, to thereby support a thrust acting on the orbiting end plate 107 and also to constrain the orbiting scroll member 106 to rotate about its own center.

According to the conventional scroll compressor of the structure described hereinabove, the driving pin 115 is fixed in position relative to the main shaft 114 and, by so fixing the position of the driving pin 115, in the event of start-up or an abrupt acceleration of the scroll compressor, an inertia force of the scroll member acts to swing the longitudinal axis of the eccentric bush 111 in such a direction as to separate the stationary and orbiting wraps away from each other to release the closed working pockets 105, to thereby minimize generation of abnormal sounds and/or vibrations.

In addition, although since the eccentric bush 111 is rotatable around the driving pin 115, the radial sealing can be achieved, the angle of rotation resulting from the swinging motion of the eccentric bush 111 must be regulated to eliminate problems associated with interference between the surrounding component parts. For this purpose, a regulating pin 113 protruding axially from the eccentric bush 111 so as to engage loosely in a regulating hole 116 formed in the main shaft 114 with a predetermined gap left between the regulating pin 113 and the wall defining the regulating hole 116 is employed as means for regulating the angle of rotation of the eccentric bush 111.

Considering, however, that in addition to the compact and light-weight construction, the high operating efficiency and the quiet features, the scroll compressor intended particularly for use in an automotive vehicle is required to have a durability against severe operating conditions such as extremely high or low operating speed and/or extremely high or low ambient temperature, the driving pin 115 employed in the conventional scroll compressor of the structure described above poses a problem associated with physical strength thereof. In other words, since the driving pin 115 is eccentrically engaged in the eccentric bush 111 which tends to be manufactured as compact as possible and having a bore size as small as possible, the driving pin 111 is limited in diameter and, therefore, the driving pin 115 of a given diameter must have a sufficient physical strength. In particular where the scroll compressor is operated under a severe condition such as a high-speed, high-load operating condition, there is a relatively high possibility of breakage of the driving pin 115.

In addition, the conventional scroll compressor requires the use of a rotational angle regulating means for regulating the angle of rotation resulting from the swinging motion of the eccentric bush 111 and is, therefore, disadvantageous in terms of manufacturability and manufacturing cost.

SUMMARY OF THE INVENTION

Accordingly, the present invention has been devised to substantially eliminate the problems inherent in the conventional scroll compressor and is intended to provide an improved highly efficient scroll compressor which exhibits a high reliability during operation under severe operating conditions such as a high-speed, high-load condition and which is sufficiently simple in structure to allow it to be manufactured at a reduced cost.

In accomplishing the above and other objectives, the scroll compressor of the present invention includes a compressor housing, stationary and orbiting scroll members in engagement with each other, and an orbital drive mechanism for imparting an orbiting motion to the orbiting scroll member. The orbiting scroll member is formed with a generally cylindrical boss extending in a direction away from the stationary scroll member. The orbital drive mechanism comprises an orbiting bearing received in the cylindrical boss, a main shaft rotatably supported by the compressor housing and having a longitudinal axis, an eccentric shaft extending from one end face of the main shaft and having a longitudinal axis parallel to, but offset laterally from the longitudinal axis of the main shaft, and an eccentric bush having a socket defined therein in coaxial relationship therewith and inserted rotatably into the cylindrical boss through the orbiting bearing.

The eccentric shaft, engaged in the socket, is of a non-circular cross-section having short and long axes perpendicular to each other. The eccentric shaft has rounded opposite apexes lying on the long axis thereof to define first and second rounded side faces, and also has third and fourth side faces defined on respective sides of the long axis thereof. The socket has first and second inner wall portions opposite to each other. The first inner wall portion confronts the first rounded side face of the eccentric shaft and is rounded so as to have a center of curvature substantially aligned with a center of curvature of the first rounded side face of the eccentric shaft, while the second inner wall portion confronts the second rounded side face of the eccentric shaft and is rounded so as to have a center of curvature substantially aligned with the center of curvature of the first rounded side face of the eccentric shaft. The socket also has third and fourth inner wall portions confronting the third and fourth side faces of the eccentric shaft, respectively, with a predetermined gap left therebetween so that the eccentric bush can swing relative to the eccentric shaft about the center of curvature of the first rounded side face of the eccentric shaft.

Preferably, the first rounded side face of the eccentric shaft lies in the second quadrant and, also, the center of curvature thereof is positioned in the second quadrant, while the second rounded side face is positioned in the fourth quadrant. In this case, a line drawn so as to extend through both of the longitudinal axis of the main shaft and the longitudinal axis of the eccentric shaft is defined as a second axis of coordinates, while a line drawn so as to extend through the longitudinal axis of the eccentric shaft in a direction perpendicular to the second axis of coordinates is defined as a first axis of coordinates, a point of intersection between the first and second axes of coordinates being defined as an origin of the coordinates. Furthermore, regions on respective sides of the first axis of coordinates remote from and adjacent to the longitudinal axis of the main shaft are positive and negative, respectively with respect to the direction of rotation of the main shaft, that region lying on one side of the second axis of coordinates in which the negative and positive regions on respective sides of the first axis of coordinates lie in this order is defined as a positive region, while that region lying on the other side of the second axis of coordinates in which the positive and negative regions on respective sides of the first axis of coordinates lie in this order is defined as a negative region. In this definition, the second quadrant is bound by negative values of the first axis of coordinates and positive values of the second axis of coordinates, while the fourth quadrant is bound by positive values of the first axis of coordinates and negative values of the second axis of coordinates. .

By the above-described construction, during the operation of the scroll compressor, a hydraulic force of a compressed gaseous medium and a centrifugal force of the scroll members and the like act on the eccentric bush to swing it relative to the eccentric shaft about the center of curvature of the first rounded side face of the eccentric shaft, which is preferably positioned in the second quadrant, thus varying the orbiting radius. Accordingly, walls of an orbiting scroll wrap are radially brought into sliding contact with walls of a stationary scroll wrap to achieve a tight radial seal effective to minimize leakage between the sealed working pockets. At the time of start-up or abrupt acceleration of the scroll compressor, an inertia force of the scroll members acts on the eccentric bush to cause it to swing in such a direction as to allow the stationary and orbiting scroll wraps to separate from each other so that the pressure inside each of the sealed working pockets may be released. Consequently, generation of abnormal sounds and vibrations and liquid compression can advantageously be lessened.

In addition, since the socket formed in the eccentric bush is located substantially at a central portion thereof, the eccentric shaft may have a substantial thickness sufficient to increase the physical strength thereof as compared with the driving pin used in the conventional scroll compressor.

Moreover, the stroke of swing of the eccentric bush relative to the eccentric shaft is determined by the size of opposite gaps defined between the third and fourth side faces of the eccentric shaft and the associated inner wall portions of the socket. Therefore, no extra means for regulating the angle of rotation such as employed in the conventional scroll compressor is needed, causing the scroll compressor to be simple in structure and low in manufacturing cost.

Advantageously, the eccentric bush has a cylindrical recess defined therein so as to open towards the main shaft and having a cross-sectional area larger than that of the socket. The main shaft has an end portion formed with a cylinder which is loosely received in the cylindrical recess. In this case, the eccentric shaft protrudes axially from an end face of the cylinder with its longitudinal axis parallel to the longitudinal axis of the main shaft.

Because of the cylindrical recess employed in the eccentric bush, the axial center of gravity of the eccentric bush is positioned at a location closer to an orbiting end plate. For this reason, even though a balance weight for lessening a dynamic unbalance is fitted to the end face adjacent the main shaft, positioning of the axial center of gravity at a location adjacent a central portion of a bearing surface of the orbiting bearing can readily be accomplished. Because of this, any possible tilt of the eccentric bush system during the orbiting motion can be suppressed to thereby increase the reliability of the orbiting bearing.

Also, because the cylinder engageable in the cylindrical recess in the eccentric bush is formed on the free end of the main shaft, the length of the eccentric shaft can be shortened to such an extent as to increase the physical strength of the eccentric shaft and, hence, the reliability thereof.

Conveniently, a through-hole is defined so as to extend from an end face of the eccentric shaft through the eccentric shaft and then through the main shaft.

Because of the through-hole so defined, lubricating oil supplied to the orbiting bearing is recirculated to the inner space of the compressor housing without being caught within the cylindrical boss, and therefore, the orbiting bearing can secure a sufficient quantity of lubricating oil, resulting in an increase in reliability.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
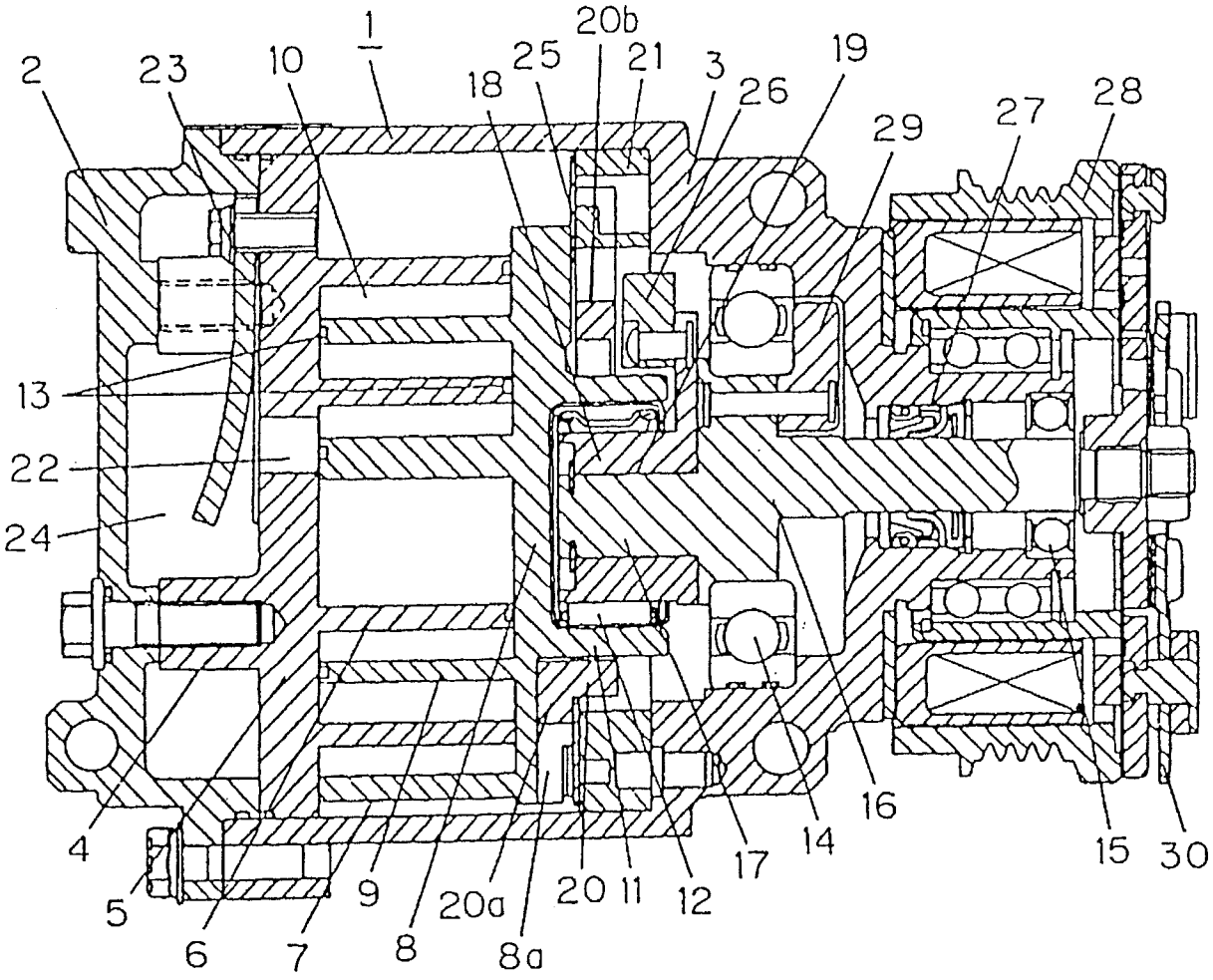
FIG. 1 is a longitudinal sectional view of a scroll compressor according to a first preferred embodiment of the present invention.
Figure 2:
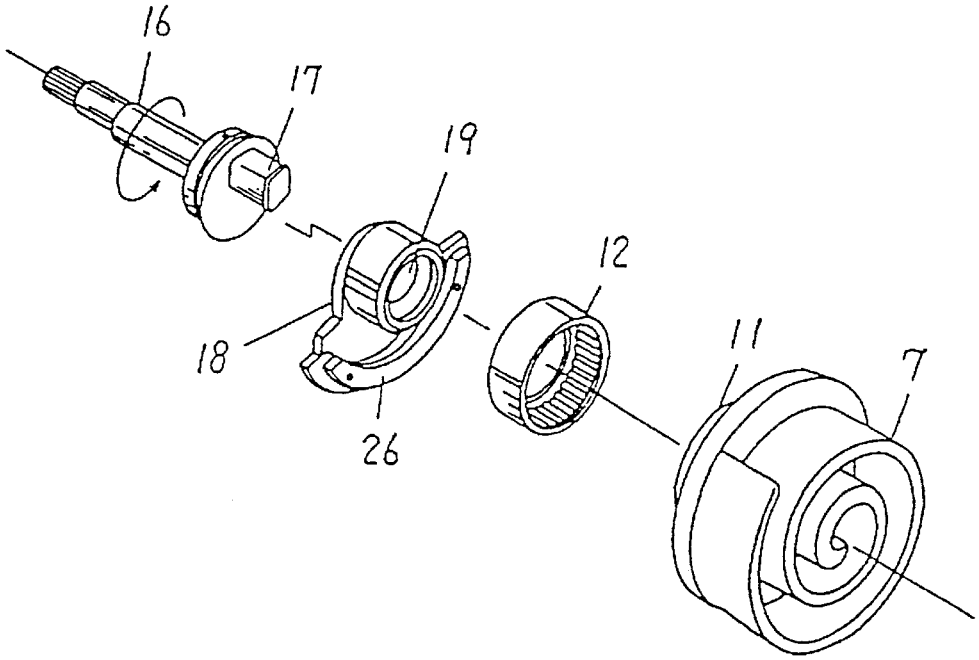
FIG. 2 is an exploded perspective view of an orbital drive mechanism employed in the scroll compressor of the present invention.
Figure 3:
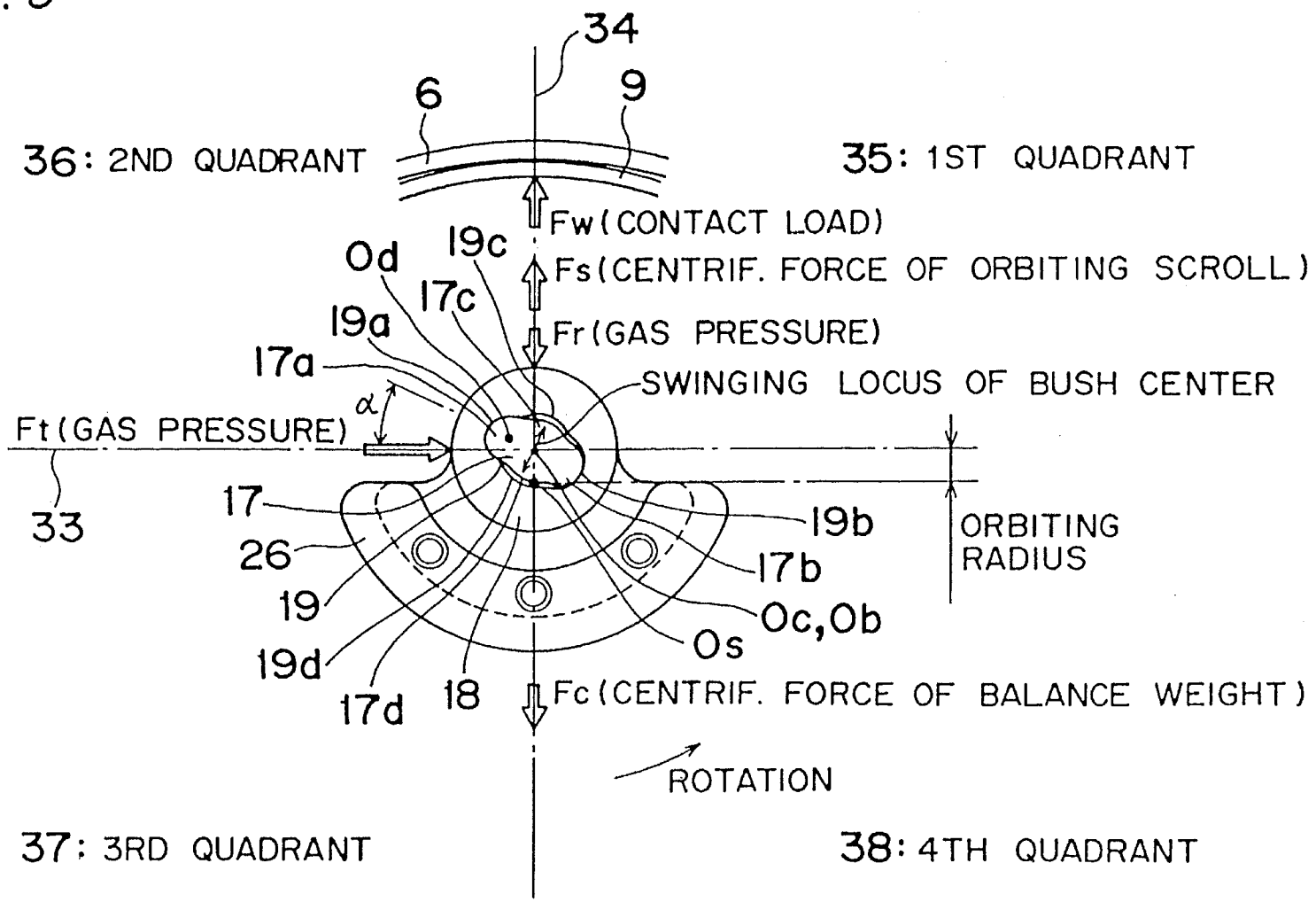
FIG. 3 is a transverse sectional view of an eccentric bush used in the scroll compressor of the present invention, showing the details of the socket defined therein in relation to an eccentric stud shaft.

FIGS. 1 to 3 pertain to a first preferred embodiment of the present invention. Referring particularly to FIGS. 1 and 2, a scroll compressor shown therein comprises a generally cylindrical compressor housing 1 including a front casing 2, in which a relatively low pressure acts, and a rear casing 3 in which a relatively high pressure acts. The front casing 2 is coupled in end-to-end fashion with the rear casing 3 to complete the generally cylindrical compressor housing 1. A stationary scroll member 4, including a stationary end plate 5 and a stationary scroll wrap 6 protruding axially from one end face of the stationary end plate 5, and an orbiting scroll member 7 similarly including an orbiting end plate 8 and an orbiting scroll wrap 9 protruding axially from one end face of the orbiting end plate 8 are operatively accommodated within the compressor housing 1 with the stationary and orbiting scroll wraps 6 and 9 engaging with each other to define a plurality of volume-variable, sealed working pockets 10.

The stationary scroll member 4 is fixed in position with the stationary end plate 5 fastened to a front end portion of the rear casing 3 adjacent the front casing 2. On the other hand, the orbiting end plate 8 is formed on a rear surface with a cylindrical boss 11 extending concentrically and transversely from the orbiting end plate 8 in a direction away from the stationary scroll member 4 and receiving therein an annular orbiting bearing 12 which may be a needle bearing. An axial outer end of each of the stationary and orbiting scroll wraps 6 and 9 opposite to the axial inner ends integrated with the corresponding end plate 5 or 8 has a tip seal 13 fitted thereto and held in sliding contact with a confronting end surface of the respective end plate 5 or 8 to establish an axial seal.

An orbiting motion of the orbiting scroll member 7 relative to the stationary scroll member 4 is carried out by a main shaft 16, rotatably supported by the compressor housing 1 through a main bearing 14 and an auxiliary bearing 15, by way of an orbital drive mechanism of a type utilizing an eccentric bush 18 as will be described later. On the other hand, the main shaft 16 is adapted to be driven by an external drive source (not shown) providing a rotary drive force which is transmitted thereto through a drive transmitting element (not shown) such as, for example, an endless belt, by way of an electromagnetic clutch 28. The electromagnetic clutch 28 is mounted on a rear end of the main shaft 16 protruding outwardly from the compressor housing 1 through an axial seal assembly 27.

The orbiting scroll member 7 undergoes an orbiting motion relative to the stationary scroll member 4 while rotation of the orbiting scroll member 7 about its own axis is prevented by a constraint member 20. This constraint member 20 has an annular end face formed with a pair of parallel keys **20*a*, slidingly engaged in corresponding key grooves 8*a* defined in the rear surface of the orbiting end plate 8, and another pair of parallel keys 20*b* located substantially 90° spaced from the pair of the parallel keys 20*a* and slidingly engaged in a rotation restraint member 21 that is fixedly inserted in the compressor housing 1 and formed with key grooves (not shown) for receiving the respective keys 20*b*. The rotation restraint member 21 constrains the constraint member 20 so that the latter can undergo movement only in one direction perpendicular to the main shaft 16**.

As is well known to those skilled in the art, the orbiting motion of the orbiting scroll member 7 relative to the stationary scroll member 4 results in the sealed working pockets moving inwardly around the stationary and orbiting scroll wraps 6 and 9 towards a center discharge port 22 accompanied by progressive reduction in volume thereof. Therefore, a gaseous medium fed into each sealed working pocket through an inlet port (not shown), and trapped in the pocket, experiences a decrease in volume and an increase in pressure as it approaches the center discharge port 22 and is subsequently discharged into a discharge cavity 24 through a unidirectional discharge valve 23. The gaseous medium so discharged into the discharge cavity 24 flows out from the compressor housing 1 through an outflow port (not shown) defined in the compressor housing 1.

A thrust generated by the gaseous medium being compressed within the sealed working pockets 10 and tending to separate the stationary and orbiting scroll members 4 and 7 away from each other is counteracted by a generally flat-shaped thrust bearing 25 interposed between an annular end face of the constraint member 21 and the rear surface of the orbiting end plate 8.

The orbital drive mechanism referred to above and operable to vary the orbiting radius that is followed by the orbiting scroll member 7 will now be described with particular reference to FIG. 2. As shown therein in an exploded view, the eccentric bush 18 has a socket 19 defined therein in coaxial relationship therewith and is inserted rotatably into the cylindrical boss 11 integral with the orbiting end plate 8 of the orbiting scroll member 7 through the annular orbiting bearing 12. The main shaft 16 has a front end integrally formed with an eccentric stud shaft 17 having its longitudinal axis parallel to, but offset a predetermined distance, corresponding to the orbiting radius, laterally from the longitudinal axis of the main shaft 16, which shaft 17 is engaged in the socket 19. The eccentric bush 18 has a balance weight 26 fitted thereto, or otherwise formed integrally therewith for providing a centrifugal force effective to counteract the centrifugal force developed by an orbiting motion of the orbiting scroll member 7 and the eccentric bush 18 itself.

FIG. 3 is a diagram showing a geometry of the eccentric bush 18 in relation to the eccentric stud shaft 17. For the purpose of the present invention, it is assumed that the line drawn so as to extend through both of the longitudinal axis Os of the main shaft 16 and the longitudinal axis Oc of the eccentric stud shaft 17 is defined as a second axis of coordinates 34; the line drawn so as to extend through the longitudinal axis Oc of the eccentric stud shaft 17 in a direction perpendicular to the second axis of coordinates 34 is defined as a first axis of coordinates 33; and the point of intersection between the first and second axes of coordinates 33 and 34 is defined as an origin of the coordinates. It is further assumed that regions on respective sides of the first axis of coordinates 33 remote from and adjacent to the longitudinal axis Os of the main shaft 16 are positive and negative, respectively, and that, with respect to the direction of rotation of the main shaft 16, that region lying on one side of the second axis of coordinates 34 in which the negative and positive regions on respective sides of the first axis of coordinates 33 lie in this order is defined as a positive region, while that region lying on the other side of the second axis of coordinates 34 in which the positive and negative regions on respective sides of the first axis of coordinates 33 lie in this order is defined as a negative region. It is also assumed that the quadrant bound by the positive values of the first and second axes of coordinates 33 and 34 is referred to as the first quadrant 35; the quadrant bound by the negative values of the first axis of coordinates 33 and the positive values of the second axis of coordinates 34 is referred to as the second quadrant 36; the quadrant bound by the negative values of the first and second axes of coordinates 33 and 34 is referred to as the third quadrant 37; and the quadrant bound by the positive values of the first axis of coordinates 33 and the negative values of the second axis of coordinates 34 is referred to as the fourth quadrant 38. In this assumption, the distance between the longitudinal axis Os of the main shaft 16 and the longitudinal axis Oc of the eccentric stud shaft 17 represents the orbiting radius.

The eccentric stud shaft 17 is of a generally rhombic cross-section having short and long axes perpendicular to each other with the long axis oriented so as to extend in both of the second and fourth quadrants 36 and 38. Opposite apexes of the cross-sectional shape of the eccentric stud shaft 17 lying on the long axis thereof are rounded to define respective rounded axial side faces 17*a* and 17*b*, said rounded axial side face 17*a* lying in the second quadrant 36 and having a center of curvature Od which also lies in the second quadrant 36 while the opposite rounded axial side face 17*b* lies in the fourth quadrant 38.

On the other hand, an axial inner wall portion 19*a* of the socket 19 which, when the eccentric stud shaft 17 is received in such socket 19, confronts the rounded axial side face 17*a* of the eccentric stud shaft 17 is also rounded at 19*a* in a sense opposite to the rounding of the axial side face 17*a* with a center of curvature substantially aligned (i.e., substantially coincident) with the center of curvature Od. Another axial inner wall portion of the socket 19 confronting the opposite rounded axial side face 17*b* of the eccentric stud shaft 17 is rounded at 19*b*, with a center of curvature thereof substantially aligned (i.e., substantially coincident) with the center of curvature Od. Thus, it will readily be understood that the socket 19 in the eccentric bush 18 is so profiled and so shaped as to have the axial inner wall portion 19*a* of a smaller curvature and the axial inner wall portion 19*b* of a greater curvature that is sidewise continuous with the axial inner wall portion 19*a*. By so designing the profile of the socket 19 in the eccentric bush 18, opposite apexes of the cross-sectional shape of the eccentric stud shaft 17 lying on the short axis thereof that define axial side faces 17*c* and 17*d* are spaced a predetermined distance inwardly from corresponding axial inner wall portions 19*c* and 19*d* of the socket 19 so that the eccentric bush 18 can swing relative to the eccentric stud shaft 17 with the longitudinal axis Ob of said eccentric bush 18 following an arcuate path having a center of curvature matching with the center of curvature Od with the distance between the centers of curvature Od and Ob being a radius of curvature of such arcuate path.

It is to be noted here that although in the above-described embodiment the eccentric stud shaft 17 has been described as being of a generally rhombic cross-section, it may be of a non-circular cross-section, other than the rhombic cross-section, having short and long axes perpendicular to each other.

The stroke of swing of the eccentric bush 18 relative to the eccentric stud shaft 17 along the arcuate path with its center of curvature aligned with the center of curvature Od is determined by the size of opposite gaps defined between the axial side faces 17*c* and 17*d* of the eccentric stud shaft 17 and the associated axial inner wall portions 19*c* and 19*d* of the socket 19 in which the eccentric stud shaft 17 is received.

During the operation of the scroll compressor, force of the compressed gaseous medium (the gas pressure Ft acting in the tangential direction and the gas pressure Fr acting in the radial direction) and the centrifugal force of the scroll members (the centrifugal force Fs of the orbiting scroll member 7 and the eccentric bush 18 and the centrifugal force Fc of the balance weight 26) appear to act on the longitudinal axis Ob of the eccentric bush 17 in a direction shown in FIG. 3. These forces are translated into a moment tending to rotate the eccentric bush 18 about the center of curvature Od so that the eccentric bush 18 can swing relative to the eccentric stud shaft 17 about the center of curvature 0d lying in the second quadrant 36, accompanied by a change in distance between the longitudinal axis Os of the main shaft 16 and the longitudinal axis Ob of the eccentric bush 18. This resultant change accounts for a change in orbiting radius, and it will readily be understood from FIG. 3 that the moment of rotation during the operation of the scroll compressor causes the eccentric bush 18 to swing relative to the eccentric stud shaft 17 in such a direction required to increase the orbiting radius.

Because of the swing motion of the eccentric bush 18, walls of the orbiting scroll wrap 9 are radially brought into sliding contact with walls of the stationary scroll wrap 6 to achieve a tight radial seal effective to minimize leakage between the sealed working pockets 10. If a contact load acting on the stationary and orbiting scroll wraps 6 and 9 at this time is too small, insufficient lines of contact takes place between the walls of the stationary and orbiting scroll wraps 6 and 9, resulting in leakage between the working pockets 10, and conversely, if it is too excessive, wear will be accelerated. Assuming that the angle formed between the first axis of coordinates 33 and the line connecting the longitudinal axis Oc of the eccentric stud shaft 17 and the center of curvature Od together is expressed by α as shown in FIG. 3, the contact load Fw is determined by the balance between the gas force (Ft and Fr) and the centrifugal force (Fc and Fs) and is given by the following equation.

$$Fw=Ft\cdot\tan\alpha+Fs-Fr-Fc \quad (1)$$

For this reason, not only is the angle α chosen properly, but also the weight of the balance weight 26 is so adjusted and so determined to avoid any possible excessive contact load during a high-speed operation. By so doing, it is possible to accomplish a smooth orbiting motion of the orbiting scroll member 7 while any possible wear of the walls of the scroll members is minimized and, at the same time, a proper radial compliance is attained.

The axial sealing bet:ween the stationary and orbiting scroll members 4 and 7 which would affect the axial leakage of the compressed gas between the sealed working pockets 10 is controlled by adjusting the thickness of a shim (not shown) inserted between the front casing 2 and the rear casing 3, and adjustment of the relative angle between the stationary and orbiting scroll members 4 and 7 is carried out by an angle adjusting rod (not shown) to be inserted into a hole (not shown) defined in the front casing 2.

Vibration of the scroll compressor resulting from a dynamic unbalance is counteracted by a balance weight 29 mounted on the main shaft 16 and operable to generate a centrifugal force in the same direction as that generated by the balance weight 26, and a counter-weight 30 mounted on the electromagnetic clutch 28 for generating a centrifugal force acting in a direction counter to the direction of the centrifugal force generated by the balance weight 29 to bring the moment generated in the compressor as a whole into equilibrium.

The scroll compressor according to the present invention is reliable in operation. Specifically, because of the employment of the orbital drive mechanism, that is, the mechanism for varying the orbiting radius, in the event of entanglement of solid foreign matter in between the stationary and orbiting scroll wraps 6 and 9, the orbiting scroll wrap 9 rides over solid particles while accompanied by a decrease of the orbiting radius, to thereby minimize scratches which would be formed on the surface of the wall of one or both of the stationary and orbiting scroll wraps 6 and 9. Also, since the center of curvature Od, that is, the axis about which the eccentric bush 18 swings, is so chosen as to lie in the second quadrant 36, an inertia force of the scroll members acts on the eccentric bush 18, at the time of start-up or abrupt acceleration of the scroll compressor, to cause the eccentric bush 18 to swing in such a direction as to allow the stationary and orbiting scroll wraps 6 and 9 to separate from each other so that the pressure inside each of the sealed working pockets 10 may be released. Consequently, generation of abnormal sounds and vibrations and liquid compression can advantageously be lessened. While this is one of the important features of the present invention, those skilled in the art will readily conceive, unless the reliability during the start of the scroll compressor as discussed above is considered of less importance, that even though the position of the center of curvature Od may be chosen to lie in the fourth quadrant, the contact load is automatically obtained by the line contacts between the stationary and orbiting scroll wraps 6 and 9 during the operation of the scroll compressor.

In addition, since the socket 19 formed in the eccentric bush 18 is located substantially at a central portion thereof, the eccentric stud shaft 17 may have a substantial thickness sufficient to increase the physical strength thereof as compared with the driving pin used in the conventional scroll compressor.

Moreover, as hereinbefore discussed, the stroke of swing of the eccentric bush 18 relative to the eccentric stud shaft 17 along the arcuate path with its center of curvature aligned with the center of curvature Od is determined by the size of opposite gaps defined between the axial side faces 17*c* and 17*d* of the eccentric stud shaft 17 and the associated axial inner wall portions 19*c* and 19*d* of the socket 19 in which the eccentric stud shaft 17 is received. Therefore, no extra means for regulating the angle of rotation such as employed in the conventional scroll compressor is needed, rendering the scroll compressor of the present invention to be simple in structure and low in manufacturing cost.

Figure 4:
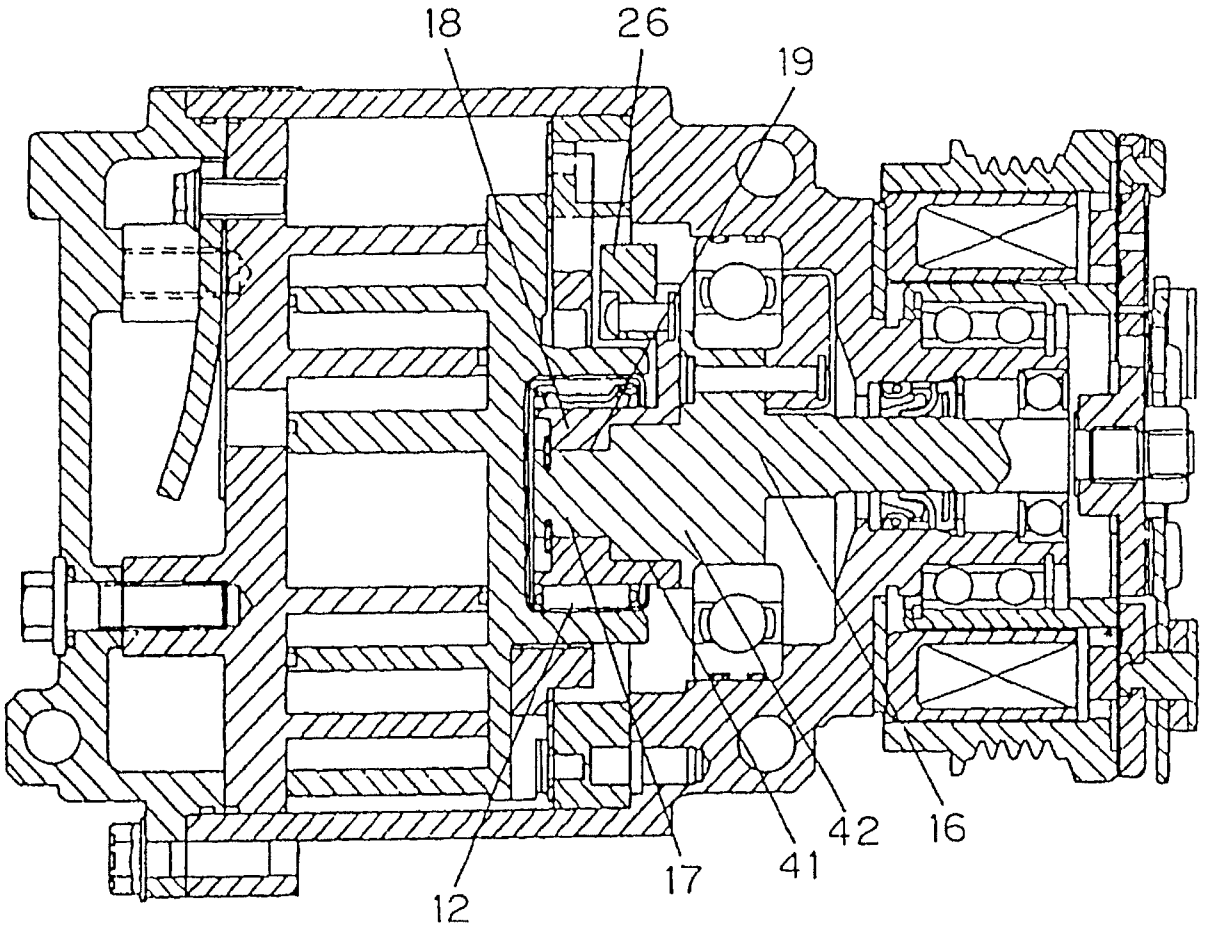
FIG. 4 is a view similar to FIG. 1, but according to a second preferred embodiment of the present invention.

The scroll compressor according to a second preferred embodiment of the present invention will now be described with particular reference to FIG. 4. The scroll compressor shown in FIG. 4 is substantially similar to that shown in FIGS. 1 to 3C. However, the eccentric bush 18 employed in the scroll compressor of FIG. 4 is of a type having a cylindrical recess 41 defined therein so as to open towards the main shaft 16, the cylindrical recess 41 having a cross-sectional area larger than that of the socket 19. The main shaft 16 that gives rise to the eccentric rotation of the eccentric bush 18 has an end portion formed with a cylinder 42 loosely received in the cylindrical recess 41. The eccentric stud shaft 17 protrudes axially from a free end face of the cylinder 42 with its longitudinal axis parallel to the longitudinal axis of the main shaft 16.

Because of the cylindrical recess 42 employed in the eccentric bush 18, the axial center of gravity of the eccentric bush 18 is positioned at a location closer to the orbiting end plate 8. For this reason, even though the balance weight 26 for lessening the dynamic unbalance is fitted to the end face adjacent the main shaft 16, positioning of the axial center of gravity at a location adjacent a central portion of a bearing surface of the annular orbiting bearing 12 can easily and readily be accomplished. Because of this, any possible tilt of the eccentric bush system during the orbiting motion can be suppressed to thereby increase the reliability of the annular orbiting bearing 12.

Also, that the cylinder 42 engageable in the cylindrical recess 41 in the eccentric bush 18 is formed on the free end of the main shaft 18 makes it possible to shorten the length of the eccentric stud shaft 17 to such an extent as to increase the physical strength of the eccentric stud shaft and, hence, the reliability thereof.

Figure 5:
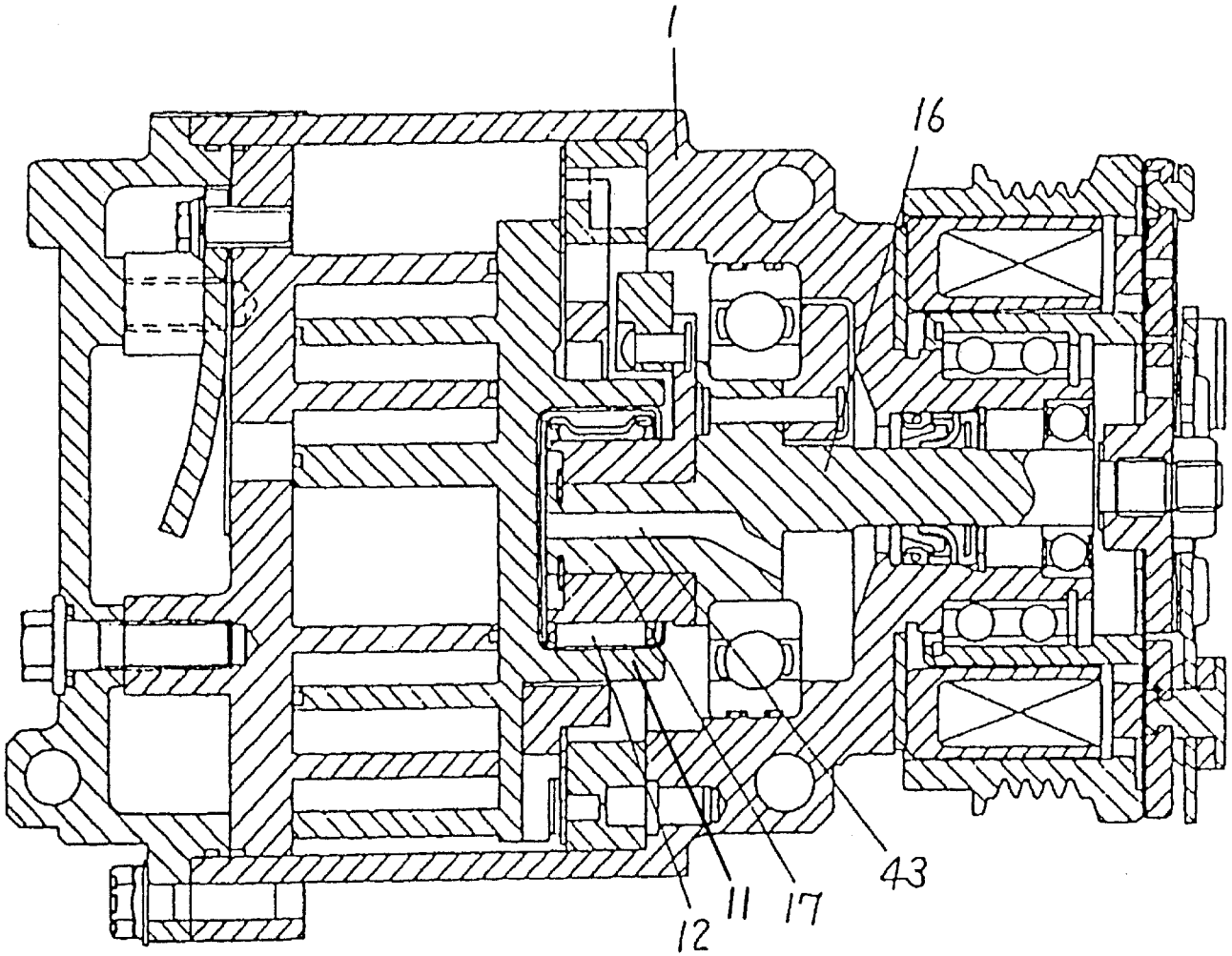
FIG. 5 is a view similar to FIG. 1, but according to a third preferred embodiment of the present invention.
Figure 6:
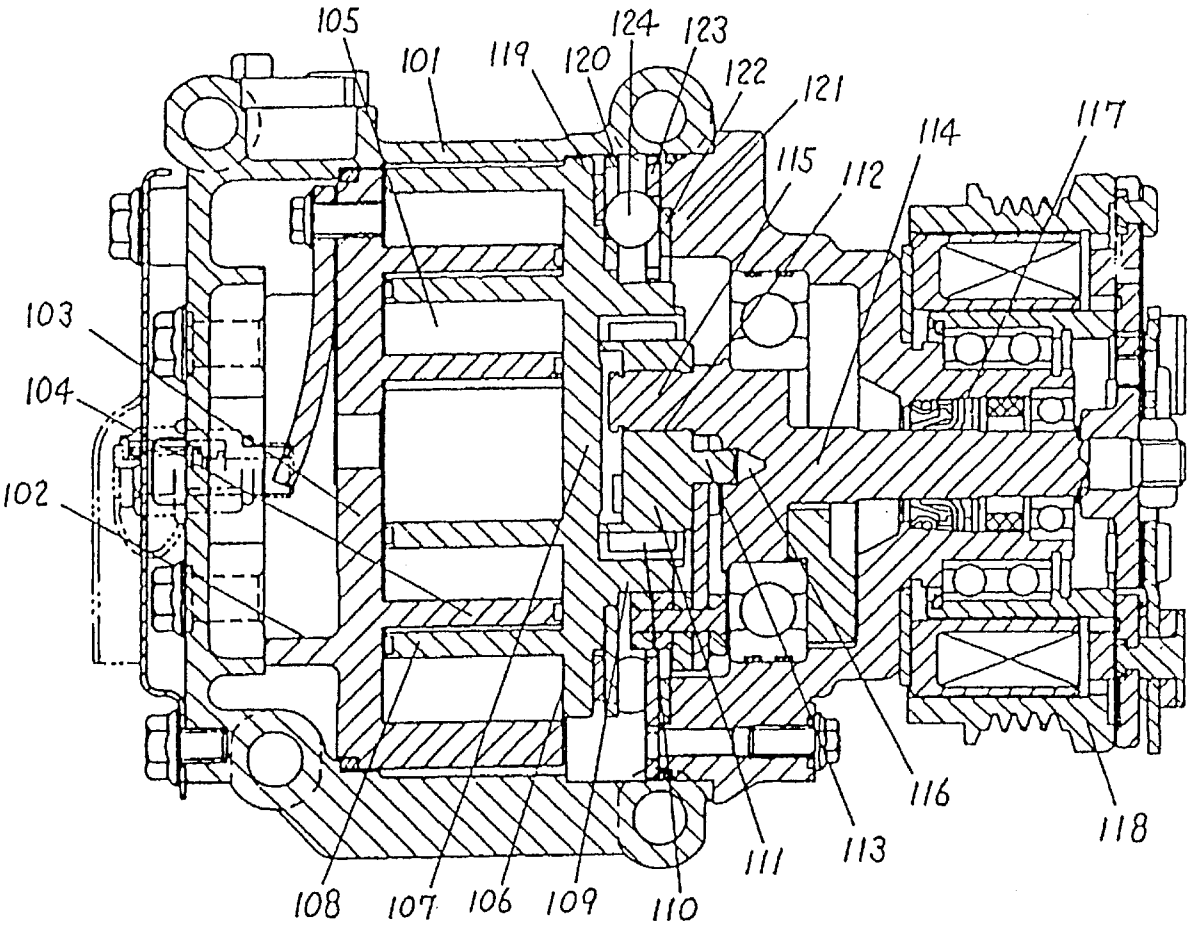
Fig. 6 PRIOR ART
FIG. 6 is a longitudinal sectional view of a conventional scroll compressor.

FIG. 5 illustrates the scroll compressor according to a third preferred embodiment of the present invention, which is similar in structure to that shown in FIGS. 1 to 3 except that a through-hole 43 is defined so as to extend from a free end face of the eccentric stud shaft 17 through the eccentric stud shaft 17 and then through the main shaft 16.

According to the third embodiment shown in FIG. 5, because of the through-hole 43 so defined, the lubricating oil supplied to the annular orbiting bearing 12 is recirculated to the inner space of the compressor housing 1 without being caught within the cylindrical boss 11, and therefore, the annular orbiting bearing 12 can secure a sufficient quantity of lubricating oil, resulting in an increase in reliability.

From the foregoing description, it is clear that the eccentric bush is swung relative to the eccentric stud shaft about the center of curvature of the rounded axial side face under the influence of such a force as the pressure of the compressed gas and the centrifugal force within accompanying variation in orbiting radius. Accordingly, the walls of the orbiting scroll wrap sweep the walls of the stationary scroll wrap at all times during the orbital motion of the orbiting scroll member while assuredly and reliably securing the radial sealing of the working pockets. In addition, positioning of the axis about which the eccentric bush swings within the second quadrant of the coordinate system as defined previously according to the present invention causes an inertia force of the scroll members to act on the eccentric bush 18, at the time of start-up or abrupt acceleration of the scroll compressor, to cause the eccentric bush 18 to swing in such a direction as to allow the stationary and orbiting scroll wraps 6 and 9 to separate from each other so that the pressure inside each of the sealed working pockets 10 is released. Consequently, generation of abnormal sounds and vibrations and liquid compression can advantageously be lessened.

Also, the stroke of swing of the eccentric bush relative to the eccentric stud shaft along the arcuate path is determined by the size of opposite gaps defined between the axial side faces of the eccentric stud shaft and the associated axial inner wall portions of the socket in which the eccentric stud shaft is received. Therefore, no extra means for regulating the angle of rotation such as employed in the conventional scroll compressor is needed, causing the scroll compressor of the present invention to be simple in structure and low in manufacturing cost.

Moreover, because of the cylindrical recess employed in the eccentric bush, the axial center of gravity of the eccentric bush is positioned at a location closer to the orbiting end plate, and for this reason, even though the balance weight for lessening the dynamic unbalance is fitted to the end face adjacent the main shaft, positioning of the axial center of gravity at a location adjacent a central portion of a bearing surface of the annular orbiting bearing can easily and readily be accomplished. Because of this, any possible tilt of the eccentric bush system during the orbiting motion can be suppressed to thereby increase the reliability of the annular orbiting bearing. Also, that the cylinder engageable in the cylindrical recess in the eccentric bush is formed on the free end of the main shaft makes it possible to shorten the length of the eccentric stud shaft to such an extent as to increase the physical strength of the eccentric stud shaft and, hence, the reliability thereof.

Furthermore, the use of the through-hole extending from the free end face of the eccentric stud shaft through the eccentric stud shaft and then through the main shaft is advantageous in that the lubricating oil supplied to the annular orbiting bearing can be recirculated to the inner space of the compressor housing without being caught within the cylindrical boss, and therefore, the annular orbiting bearing can secure a sufficient quantity of lubricating oil, resulting in an increase in reliability.

Although the present invention has been described in connection with the preferred embodiments thereof with reference to the accompanying drawings, it is to be noted that various changes and modifications will be apparent to those skilled in the art. By way of example, although the present invention has fully been described in connection with the open-type compressor for use in an automotive vehicle in which a low pressure evolves within the compressor housing, the present invention is not limited to such type and is equally applicable to a hermetically sealed scroll compressor having an electric motor built therein and a high-pressure type compressor, both of which include the compressor housing in which a high pressure evolves.

Accordingly, such changes and modifications are to be understood as included within the scope of the present invention as defined by the appended claims, unless they depart therefrom.

What is claimed is:

1. In a scroll compressor having a compressor housing and stationary and orbiting scroll members in engagement with each other, said orbiting scroll member being formed with a generally cylindrical boss extending in a direction away from said stationary scroll member, wherein the improvement comprises:

an orbital drive mechanism for imparting an orbiting motion to said orbiting scroll member and comprising:

an orbiting bearing received in said cylindrical boss;

a main shaft rotatably supported by said compressor housing and having a central longitudinal axis;

an eccentric shaft extending from one end face of said main shaft and having a central longitudinal axis parallel to, but offset laterally from the central longitudinal axis of said main shaft;

an eccentric bush having a socket defined therein in coaxial relationship therewith and inserted rotatably into said cylindrical boss through said orbiting bearing, said eccentric shaft being engaged in said socket;

said eccentric shaft being of a non-circular cross-section having short and long axes perpendicular to each other, said eccentric shaft having rounded opposite apexes lying on the long axis thereof to define first and second rounded side faces and also having third and fourth side faces defined on respective sides of the long axis thereof, said first rounded side face having a center of curvature offset laterally from the central longitudinal axis of said eccentric shaft; and said socket having first and second inner wall portions opposite to each other, said first inner wall portion confronting said first rounded side face of said eccentric shaft and being rounded so as to have a center of curvature substantially coincident with the center of curvature of said first rounded side face of said eccentric shaft, said second inner wall portion confronting said second rounded side face of said eccentric shaft and being rounded so as to have a center of curvature substantially coincident with the center of curvature of said first rounded side face of said eccentric shaft, said socket also having third and fourth inner wall portions confronting said third and fourth side faces of said eccentric shaft, respectively, with a predetermined gap left therebetween so that said eccentric bush can swing relative to said eccentric shaft about the center of curvature of said first rounded side face of said eccentric shaft.

2. The scroll compressor according to claim 1, wherein said eccentric bush has a cylindrical recess defined therein so as to open towards said main shaft, said cylindrical recess having a cross-sectional area larger than that of said socket, said main shaft having an end portion formed with a cylinder which is loosely received in said cylindrical recess, said eccentric shaft protruding axially from an end face of said cylinder with its longitudinal axis parallel to the longitudinal axis of said main shaft.

3. The scroll compressor according to claim 1, wherein a through-hole is defined so as to extend from an end face of said eccentric shaft through said eccentric shaft and said main shaft.

4. A scroll compressor comprising:

a compressor housing;

a stationary scroll member accommodated in said compressor housing and having a stationary end plate and a stationary scroll wrap protruding axially from said stationary end plate;

an orbiting scroll member accommodated in said compressor housing and having an orbiting end plate and an orbiting scroll wrap protruding axially from said orbiting end plate, said orbiting scroll wrap being in engagement with said stationary scroll wrap to define a plurality of working pockets, said orbiting end plate being formed with a generally cylindrical boss extending in a direction away from said stationary scroll member; and an orbital bearing received in said cylindrical boss;

a main shaft rotatably supported by said compressor housing and having a central longitudinal axis;

an eccentric shaft extending from one end face of said main shaft and having a central longitudinal axis parallel to, but offset laterally from the central longitudinal axis of said main shaft;

an eccentric bush having a socket defined therein in coaxial relationship therewith and inserted rotatably into said cylindrical boss through said orbiting bearing, said eccentric shaft being engaged in said socket;

a constraint member for preventing rotation of said orbiting scroll member about its own axis but allowing said orbiting scroll member to undergo an orbiting motion relative to said stationary scroll member;

said eccentric shaft being of a non-circular cross-section having short and long axes perpendicular to each other with the long axis oriented so as to extend in both second and fourth quadrants, said eccentric shaft having rounded opposite apexes lying on the long axis thereof to define first and second rounded side faces and also having third and fourth side faces defined on respective sides of the long axis thereof, said first rounded side face lying in the second quadrant and having a center of curvature which lies in the second quadrant and is offset laterally from the central longitudinal axis of said eccentric shaft, said second rounded side face lying in the fourth quadrant; and said socket having first and second inner wall portions opposite to each other, said first inner wall portion confronting said first rounded side face of said eccentric shaft and being rounded so as to have a center of curvature substantially coincident with the center of curvature of said first rounded side face of said eccentric shaft, said second inner wall portion confronting said second rounded side face of said eccentric shaft and being rounded so as to have a center of curvature substantially coincident with the center of curvature of said first rounded side face of said eccentric shaft, said socket also having third and fourth inner wall portions confronting said third and fourth side faces of said eccentric shaft, respectively, with a predetermined gap left therebetween so that said eccentric bush can swing relative to said eccentric shaft about the center of curvature of said first rounded side face of said eccentric shaft, wherein a line drawn so as to extend through both the longitudinal axis of said main shaft and the longitudinal axis of said eccentric shaft is defined as a second axis of coordinates, while a line drawn so as to extend through the longitudinal axis of said eccentric shaft in a direction perpendicular to the second axis of coordinates is defined as a first axis of coordinates, a point of intersection between the first and second axes of coordinates being defined as an origin of the coordinates, wherein regions on respective sides of the first axis of coordinates remote from and adjacent to the longitudinal axis of said main shaft are positive and negative, respectively, and that, with respect to the direction of rotation of said main shaft, that region lying on one side of the second axis of coordinates in which the negative and positive regions on respective sides of the first axis of coordinates lie in this order is defined as a positive region, while that region lying on the other side of the second axis of coordinates in which the positive and negative regions on respective sides of the first axis of coordinates lie in this order is defined as a negative region, and wherein said second quadrant is bound by negative values of the first axis of coordinates and positive values of the second axis of coordinates, while said fourth quadrant is bound by positive values of the first axis of coordinates and negative values of the second axis of coordinates.

5. The scroll compressor according to claim 4, wherein said eccentric bush has a cylindrical recess defined therein so as to open towards said main shaft, said cylindrical recess having a cross-sectional area larger than that of said socket, said main shaft having an end portion formed with a cylinder which is loosely received in said cylindrical recess, said eccentric shaft protruding axially from an end face of said cylinder with its longitudinal axis parallel to the longitudinal axis of said main shaft.

6. The scroll compressor according to claim 4, wherein a through-hole is defined so as to extend from an end face of said eccentric shaft through said eccentric shaft and said main shaft.

* * * * *